US005546620A

United States Patent [19]

Matthews

[11] Patent Number: 5,546,620

[45] Date of Patent: Aug. 20, 1996

[54] BABY SUPPORT WITH INTERCONNECTABLE PLAY TOYS

[76] Inventor: Susan H. Matthews, 29753 Canterbury Cir., Evergreen, Colo. 80439

[21] Appl. No.: 292,240

[22] Filed: Aug. 17, 1994

[51] Int. Cl.[6] ..... A47C 20/02

[52] U.S. Cl. ..... 5/655; 5/639

[58] Field of Search ..... 5/482, 636, 639, 5/655

[56] References Cited

U.S. PATENT DOCUMENTS

| | | | |
|---|---|---|---|
| D. 94,702 | 2/1935 | Marks | 5/636 |
| D. 124,296 | 12/1940 | Thompson . | |
| D. 285,635 | 9/1986 | Marschak | 5/482 |
| D. 328,683 | 8/1992 | Kalozdi | 5/655 |
| 2,078,022 | 4/1937 | Roemer | 46/1 |
| 3,426,372 | 2/1969 | Enelow | 5/636 |
| 3,911,512 | 10/1975 | Plate | 5/636 |
| 4,197,604 | 4/1980 | Nakamura | 5/437 |
| 4,236,264 | 12/1980 | Britzman | 5/435 |
| 4,285,081 | 8/1981 | Price | 5/434 |
| 4,594,072 | 6/1986 | Cowell | 446/227 |
| 4,679,262 | 7/1987 | Davis et al. | 5/434 |
| 4,726,085 | 2/1988 | Antonio | 5/434 |
| 4,731,890 | 3/1988 | Roberts | 5/431 |
| 4,788,728 | 12/1988 | Lake | 5/434 |
| 4,790,042 | 12/1988 | Reich | 5/655 |
| 4,914,765 | 4/1990 | Smith | 5/434 |
| 4,980,937 | 1/1991 | Mason et al. | 5/655 |
| 5,056,533 | 10/1991 | Solano | 128/845 |
| 5,103,514 | 4/1992 | Leach | 5/655 |
| 5,261,134 | 11/1993 | Matthews | 5/655 |
| 5,279,237 | 1/1994 | Alivizatos | 5/655 |
| 5,371,909 | 12/1994 | McCarty | 5/655 |

FOREIGN PATENT DOCUMENTS

| | | | |
|---|---|---|---|
| 195057 | 1/1958 | Austria | 5/636 |
| 1076118 | 10/1954 | France | 5/636 |
| 2379268 | 2/1977 | France . | |
| 4237792 | 11/1992 | Germany | 5/655 |

*Primary Examiner*—Michael J. Milano
*Attorney, Agent, or Firm*—Sheridan Ross & McIntosh

[57] ABSTRACT

A multifunctional baby device including a substantially toroidal shaped cushion having at least one strap for preferably removably securing a play toy to the device. The device may also include a mat integrally interconnected with the cushion for providing a clean, soft surface. This mat may define an interior portion of the cushion and may also extend beyond to cushion to provide a suitable surface for diaper changing. A baby may be placed in the cushion in a supine position whereupon the cushion provides support to the baby's head, or in a prone position whereupon the cushion provides support to the baby's chest. Preferably, the toys are interconnected with the support such that they are accessible only when the baby is in the noted prone position.

19 Claims, 3 Drawing Sheets

BABY SUPPORT WITH INTERCONNECTABLE PLAY TOYS

FIELD OF THE INVENTION

The present invention relates generally to baby products and, more particularly, to a multifunctional baby device which includes a resilient support (i.e., a cushion) having one or more play toys interconnectable therewith.

BACKGROUND OF THE INVENTION

A wide variety of baby products are available. For instance, resilient cushions have been developed which account for the special support needs of infants. One such cushion is disclosed in U.S. Pat. No. 5,261,134 to Matthews and is marketed under the name "BOPPY®" by the assignee of this patent application. These types of cushions typically are structured to maintain the infant in a predetermined position and to restrict the infant's movement therein to a predetermined degree.

Play mats have also been a largely commercially successful baby product. These play mats are effectively small blankets having one or more toys, mirrors, or the like attached thereto for stimulating the interests of the baby. However, in contrast to the above-noted support cushions, known play mats do not provide for any particular positioning of the infant or baby thereon. Therefore, the movement of the infant/baby is unrestrained.

Notwithstanding the large number of existing baby products, there remains a need for a multifunctional baby device which not only desirably supports the baby in one or more predetermined positions (e.g., by cradling the baby in a desired manner), but which also incorporates one or more toys.

SUMMARY OF THE INVENTION

The present invention is generally a multifunctional baby device. More particularly, the present invention is a cushion which supports the baby in one or more predetermined positions and which also incorporates one or more straps such that toys may be desirably incorporated with the support. In one embodiment, the cushion is a resilient support which includes a back portion and two laterally displaced side portions interconnected therewith. The back portion and two side portions thereby collectively define a region or cavity in which a baby may be positioned in multiple orientations. These orientations include a supine orientation wherein the back portion of the resilient cushion supports the baby's head and/or neck, and a prone orientation wherein the back portion of the resilient cushion supports the baby's chest.

As noted, the multifunctional baby device of the present invention also includes at least one strap attached to the resilient support for interconnecting a toy therewith. Preferably, this strap provides for a detachable interconnection with the toy (e.g., velcro), for instance such that toys may be used interchangeably. Moreover, preferably all straps are attached to the support in a location whereby the toys will only be accessible by the baby when in the above-noted prone position, such as by being only along the noted back portion. Moreover, preferably the strap(s) are positioned so as to not interfere with the support function of the device (e.g., by not being attached to the upper region of the support).

The noted multifunctional baby device may also incorporate a mat. This mat may occupy the interior cavity region of the support defined by the back portion and two side portions of the support in which the baby is positioned (e.g., such that the baby does not contact the floor when within the support) and/or may extend beyond the ends of the two side portions (e.g., to provide a suitable surface for diaper changing). Preferably, the mat and support are integrally formed. For instance, the resilient support may be positioned between two sheets of material and a separate strip may be used for interconnecting the two sheets about the entire perimeter of the device by sewing or other suitable means. This strip then provides a desirable location for attaching the above-noted strap(s) to the support.

DETAILED DESCRIPTION

Figure 2:
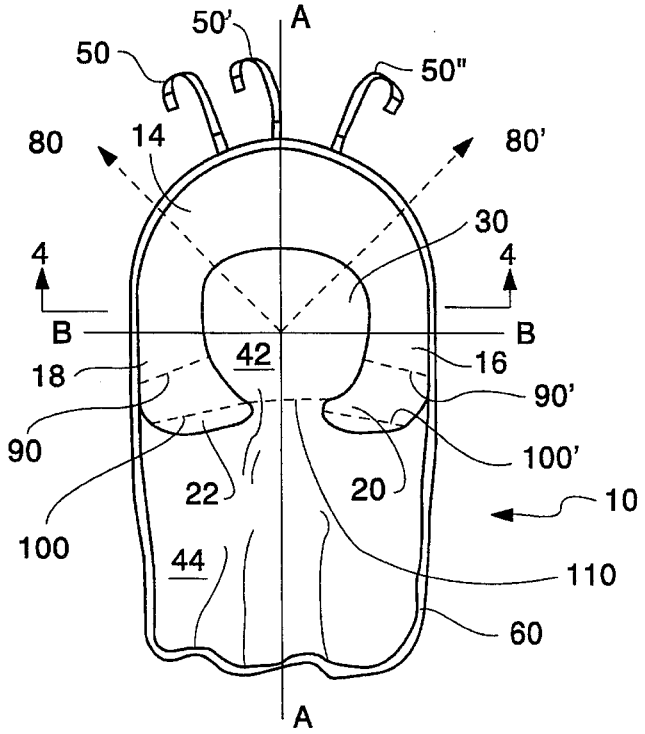
FIG. 2 is a top view of the baby device of FIG. 1.

The present invention will be described in relation to the accompanying drawings which assist in illustrating its various features. One embodiment of the structure of a multifunctional baby device in accordance with the present invention is illustrated in FIGS. 1–4. The baby device 10 includes a resilient support cushion 12 having a back section 14, a first side section 16, and a second side section 18. The back section 14 is generally defined herein as the region between the reference lines 80, 80' in FIG. 2 which originate at the intersection of central longitudinal axis A—A and central lateral axis B—B. The first and second side sections 16, 18 of the support cushion 12 are substantially crescent-shaped to define a support cushion 12 which is substantially toroidal in shape and which is substantially symmetrical about the central longitudinal axis A—A (FIG. 2). The first and second side sections 16, 18 also have end portions 20, 22, respectively, which taper inwardly toward each other. Consequently, the back section 14 and side sections 16, 18 collectively define a cavity or recess 30 for supportably receiving a baby as will be discussed below.

Figure 3:
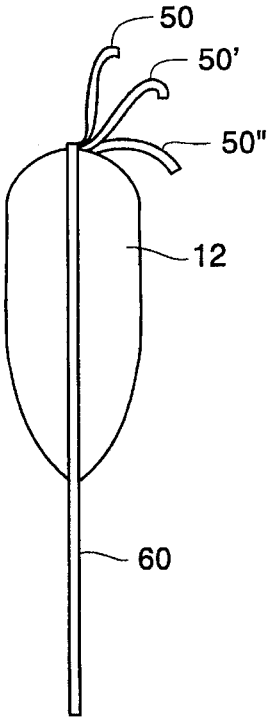
FIG. 3 is a side view of a baby device of FIG. 1.
Figure 4:
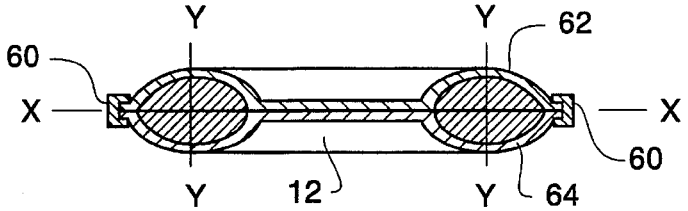
FIG. 4 is cross-sectional view of the baby device of FIG. 1 taken along line 4—4 in FIG. 2.

Referring to FIG. 3, the thickness of the support 12 is progressively reduced or tapered from the rear of the support 12 to the front of the support 12 (e.g., the support 12 is wedge-shaped to a degree from a side profile). Moreover, the noted sections of the support 12 each have a substantially elliptical configuration. More specifically and referring to FIG. 4, it can be seen that the support cushion 12 is substantially elliptical in cross section, having a major axis X—X along a substantially horizontal or medial reference plane and a pair of minor axes Y—Y along laterally displaced and substantially vertical planes. The thickness (i.e., the vertical distance from an upper surface to a lower surface) of the back section 14 of the support cushion 12 at a mid portion on the central axis A—A is about 4 ¼ inches, and at a mid portion on each of the reference lines 80, 80' is about 3½ inches. The width (i.e., the perpendicular distance between an interior edge adjacent the cavity 30 and an exterior edge on the perimeter) of the back section 14 of the disclosed support cushion 12 along the central axis A—A is about 6½ inches, and is about 6 inches along each of the reference lines 80, 80'. The thickness (as defined above) of the side sections 16, 18 of the support cushion 12 is about 3 inches at the location of FIG. 4 at a mid portion thereof, is about 2½ inches at a mid portion along each of the reference lines 90, 90' and is about 2 inches at a mid portion along each of the reference lines 100, 100' at the end portions 20, 22, respectively. The width (as defined above) of the side sections 16, 18 of the support cushion 12 is about 5 inches at the location of FIG. 4, is about 4¾ inches along each of the reference lines 90 90' and is about 5¼ inches along each of the reference lines 100, 100' at the end portions 20, 22, respectively. Consequently, the support 12 tapers downwardly from the back section 14 to the end portions 20, 22 at an angle of about 8–10° from a horizontal reference plane.

As noted, the back section 14 and side sections 16, 18 define a cavity 30 for receiving a baby in the support cushion 12. The cavity 30 measures approximately 6 inches along the central longitudinal axis A—A between the back section 14 and reference line 110, and approximately 7½ inches along the central lateral axis B—B illustrated in FIG. 2. Moreover, this cavity 30 is effectively closed in that the end portions 20, 22 are separated by a distance of about 3 inches when not subjected to a spreading force.

The support 12 may be formed from a variety of cushioning materials such as polyester fiber fill with a cotton cover, and the support 12 is preferably of a relatively firm resiliency. This, together with the above-noted dimensions, provides a suitable cushioning support for average-movement babies of up to one year of about age. That is, the support 12 is specifically designed for babies up to an age of one-year with average movement capabilities. However, it should be appreciated that support cushions having different dimensions in accordance with differently-sized infants are within the scope of the present invention.

The baby device 10 of the present invention also includes a mat 40 which is preferably integrally interconnected with the support 12 and which provides a clean, soft surface onto which the baby may be placed. The mat 40 includes a first portion 42 which is disposed within the cavity 30 (e.g., provides a surface between the baby and the floor when the baby is supportably received within the support 12) and a second portion 44 which extends beyond the support 12 (e.g. to provide a suitable surface for diaper changing). In one embodiment, the second portion 44 extends beyond the end portions 20, 22 a distance of about 10 inches along axis A—A, although other lengths of the second portion 44 may be appropriate.

As noted, preferably the support 12 and mat 40 are integrally formed. Referring to FIG. 4, the baby device 10 is formed from first sheet 62, second sheet 64, and interconnecting strip 60. More specifically, the support 12 is appropriately positioned between the first and second sheets 62, 64 and the strip 60 is positioned about the perimeter of the baby device 10. The first and second sheets 62, 64 via the strip 60 are then sewn together about this perimeter, and the first and second sheets 62, 64 are also sewn together to define the remaining perimeter of the support 12 (e.g., a seam is sewn along the outer perimeter of the support 12 where the first and second side sections 16, 18 taper inwardly, as well as on the inner perimeter of the support 12 about the cavity 30). This particular methodology is effective for assembling the baby device 10 and also effectively secures the support 12 in place. Moreover, this manner of interconnecting the support 12 and mat 40 also limits the extent to which the tapered ends 20, 22 of support 12 may be separated. In one embodiment, mat 40 limits the amount which the end portions 20, 22 may be separated to a distance of approximately 5½ inches.

The above-described methodology of assembling the baby device 10 also provides for a desired interconnection of one or more toys with the support 12. In this regard, at least one strap may be attached to the support 12 for interconnecting toy(s) therewith. For instance, straps 50, 50', 50" may be spaced along and attached to the support 12. These straps 50, 50', 50" are preferably positioned only on the back section 14 of support cushion 12 and are preferably attached to the interconnecting strip 60. Moreover, preferably the straps 50, 50', 50" allow for a detachable interconnection with the toy(s). In the disclosed embodiment, the straps 50, 50' and 50" may be looped through the handles of infant toys 52, 54, 56 and may be fastened thereto using velcro tabs, snaps, or other suitable fasteners to provide for the desired detachable interconnection.

In the disclosed embodiment, straps 50, 50' 50" are positioned to be out of the reach of the baby/infant placed in the device in a supine position. More particularly, it has been determined that when straps 50, 50', 50" are secured to only the back section 14 of support cushion 12, preferably a lateral distance of less than about 8 inches from the central axis A—A, and more preferably a lateral distance of less than about 6 inches from the central axis A—A, a baby cannot reach toys secured in straps 50, 50', 50" when the baby is positioned in the cushion in a supine position. Moreover, preferably the straps 50, 50', 50" are attached to the support 12 outside of a region above a medial reference plane which contains the above-defined axis X—X.

Figure 1:
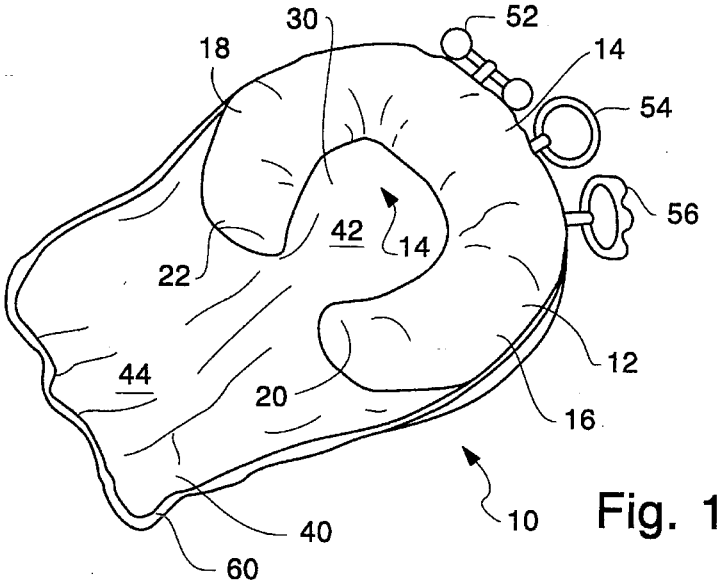
FIG. 1 is a perspective view of a baby device in accordance with principles of the present invention.
Figure 5:
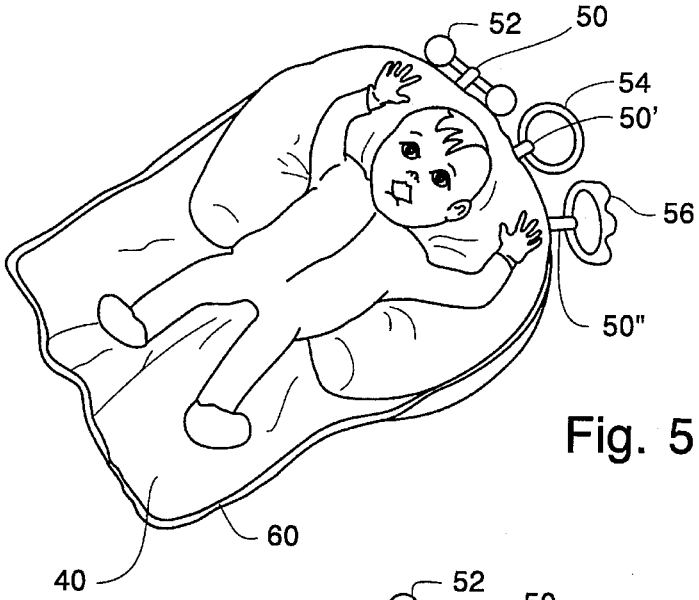
FIG. 5 is a perspective view of the baby device of FIG. 1 illustrating the supporting of a baby in a supine position.
Figure 6:
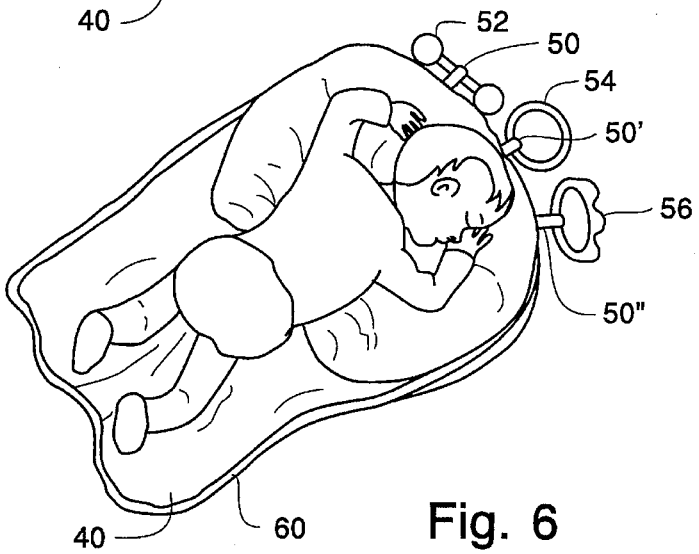
FIG. 6 is a perspective view of a baby device of FIG. 1 illustrating the supporting of a baby in a first prone position.
Figure 7:
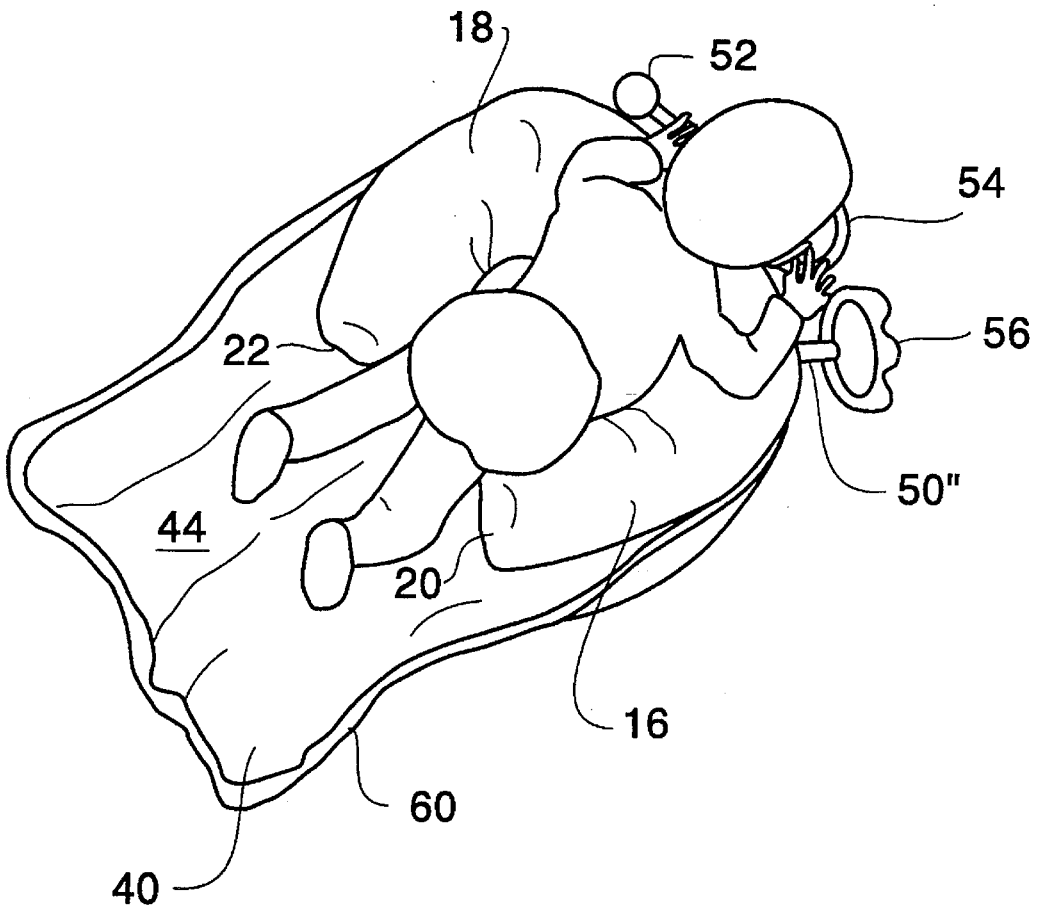
FIG. 7 is a perspective view of a baby device of FIG. 1 illustrating the supporting of a baby in a second prone position.

The multifunctional baby device 10 accommodates for a number of positionings of the baby therein and such are illustrated in FIGS. 5–7. For instance, a baby may be placed within the cavity 30 defined by cushion 12 in either a supine position as illustrated in FIG. 5, or in a prone position as illustrated in FIGS. 6–7. When a baby is placed in the cavity 30 defined by cushion 12 in a supine position, the baby's head and/or neck is substantially supported by the back section 14 of the cushion 12. The support 12, when dimensioned in the above-noted manner and for baby's of up to one-year of age with average movement capabilities, desirably retains and supports the baby in this position. It should be noted that the removable toys secured to straps 50, 50', 50" are not accessible by the baby when the baby is resting on the cushion is this supine position. The underlying mat 40 also provides a clean, soft environment upon which the baby may rest and reduces the possibility of spills or other messes associated with infants soiling the surface upon which the device 10 is placed.

The baby may also be placed in the cavity 30 formed by cushion 12 in a prone position as illustrated in FIGS. 6 and 7. In the position illustrated in FIG. 7, the back section 14 of support cushion 12 supports the chest of the baby and the toys 52, 54, 56 are within the baby's reach. That is, the baby is able to reach the toys without undue difficulty. Moreover, again the underlying mat 40 also provides a clean, soft environment upon which the baby may rest.

The foregoing description of the present invention has been presented for purposes of illustration and description.

Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A multi-functional baby device, comprising:

a resilient support comprising a back portion and two laterally displaced side portions each interconnected with said back portion and each having end portions longitudinally displaced from said back portion;

at least one strap interconnected with said support;

at least one toy interconnected with said at least one strap;

a mat interconnected with said support, wherein a first portion of said mat extends away from said end portions of said two side portions and a second portion of said mat integral with said first portion, occupies an interior region of said support defined by said two side portions and said back portion, wherein said mat and said support are both formed from an upper layer, a separate lower layer, and a separate strip, wherein said strip is attached to each of said upper and lower layers.

2. A baby device, as claimed in claim 1, wherein:

each of said side portions are generally crescent-shaped, said end portions of said side portions each tapering inwardly toward a central, longitudinal axis of said support.

3. A baby device, as claimed in claim 1, wherein:

said back portion and said two side portions substantially define a cavity having first and second dimensions, said first dimension being along a central, longitudinal axis of said cavity and said second dimension being along a central, lateral axis of said cavity and thereby substantially perpendicular to said first dimension, wherein said first dimension is about 6 inches.

4. A baby device, as claimed in claim 3, wherein:

said second dimension is about 7½ inches.

5. A baby device, as claimed in claim 1, wherein:

an upper surface of said resilient support tapers downwardly from said back portion toward said end portions of said side portions at an angle ranging from about 8° to about 10° from a horizontal reference plane.

6. A baby device, as claimed in claim 1, wherein:

ends of said end portions of said two side portions are separated by a distance of about 3 inches.

7. A baby device, as claimed in claim 1, further comprising:

means for limiting movement of said end portions of said side portions away from each other.

8. A baby device, as claimed in claim 1, wherein:

said at least one strap is positioned on said back portion.

9. A baby device, as claimed in claim 1, wherein:

a baby may be positioned in said support in first and second positions, said first position being a supine orientation whereby said baby's head is supported by at least part of said back portion and said second position being a prone orientation whereby said baby's chest is supported by at least part of said back portion.

10. A baby device, as claimed in claim 1, wherein:

a medial reference plane extends through said back portion and both of said side portions of said support to define upper and lower regions, and wherein each said strap is interconnected with said support in at least one of two positions, one of said positions being on said medial reference plane and one of said positions being in said lower region.

11. A baby device, as claimed in claim 1, further comprising:

a plurality of said straps.

12. A baby device, as claimed in claim 1, wherein:

said at least one strap comprises means for detachably connecting said at least one toy to said strap and thereby to said support.

13. A baby device, as claimed in claim 1, wherein:

said back portion and said two side portions define a cavity and a medial reference plane extends through said back portion and said two side portions, said second portion of said mat extending between said back portion and said two side portions, and being interconnected with said back portion and each of said two side portions at a location generally within said medial reference plane.

14. A baby device, as claimed in claim 1, wherein:

each said strap is interconnected with said back portion of said resilient support no higher than a horizontal midline of said back portion.

15. A baby device, as claimed in claim 9, wherein:

each said strap is interconnected with said support in a position whereby each said toy interconnected with said strap is inaccessible by said baby when in said first position and is accessible by said baby when in said second position.

16. A method for supporting a baby in a resilient support comprising a back portion and two laterally displaced side portions each interconnected with said back portion and each having end portions longitudinally displaced from said back portion, wherein at least one strap is interconnected with said support and at least one toy is interconnected with said at least one strap, said method comprising the steps of:

positioning said baby between said back portion and said side portions in a first position comprising a supine orientation;

precluding said baby from accessing said at least one toy attached to said at least one strap when in said first position;

positioning said baby between said back portion and said side portions in a second position comprising a prone orientation; and allowing said baby to access said at least one toy interconnected with said at least one strap when in said second position.

17. A method, as claimed in claim 16, wherein:

said second position further comprises at least a portion of a chest of said baby engaging said back portion of said resilient support.

18. A method, as claimed in claim 16, wherein:

said precluding and allowing steps comprising positioning each said strap on said back portion of said resilient support.

19. A method, as claimed in claim 18, wherein:

said precluding and allowing steps further comprise interconnecting each said strap to said back portion of said resilient support no higher than a horizontal midline of said back portion.

* * * * *